US005899557A

United States Patent [19]

McDermott

[11] Patent Number: 5,899,557

[45] Date of Patent: May 4, 1999

[54] MULTI-SOURCE LIGHTING DEVICE

[76] Inventor: Kevin McDermott, 196 Phillips Dr., Hampstead, Md. 21074

[21] Appl. No.: 08/289,051

[22] Filed: Aug. 11, 1994

[51] Int. Cl.[6] ..... F21V 5/00

[52] U.S. Cl. ..... 362/244; 362/246; 362/318; 362/800

[58] Field of Search ..... 362/244, 245, 362/246, 800, 318

[56] References Cited

U.S. PATENT DOCUMENTS

| | | | |
|---|---|---|---|
| 4,185,891 | 1/1980 | Kaester | 362/800 |
| 4,733,335 | 3/1988 | Serizawa et al. | 362/800 |
| 4,941,072 | 7/1990 | Yasumoto et al. | 362/800 |
| 5,039,832 | 8/1991 | Polacek et al. | 362/800 |
| 5,224,773 | 7/1993 | Arimura . | |
| 5,349,504 | 9/1994 | Simms et al. | 362/800 |
| 5,375,043 | 12/1994 | Makoto | 362/800 |

*Primary Examiner*—Carroll D. Dority

*Attorney, Agent, or Firm*—McAulay Nissen Goldberg Kiel & Hand, LLP

[57] ABSTRACT

A Multi-Source electronic lighting device for use as a signal or illuminator. Light is created by a plurality light emitting diode elements which are encapsulated in a light transmitting medium. A curved cylindrical lens is contoured to cooperate with the location of the light emitting diode elements to create a composite light beam with a controlled beam pattern which is elongated in a defined plane. The intensity of the projected light beam is maximized through the efficient collection of created light.

31 Claims, 3 Drawing Sheets

MULTI-SOURCE LIGHTING DEVICE

BACKGROUND OF INVENTION

Typical of prior art for a wide angle lighting device would be a circular fresnel lens incandescent lamp combination as can be found on buoy lights used to navigate boats.

In these designs a fresnel or plano-convex lens is formed in the horizontal plane into a circular pattern. The lens is contoured in the vertical plane so that a single focal point is located at the center of the circular pattern. The incandescent lamp is positioned at that focal point resulting in a projected beam pattern which has a 360 degree beamwidth in the horizontal plane and minimal beamwidth in the vertical plane. in effect, the design collects light created by the incandescent source which is emitted at substantial angles above and below the horizontal plane and redirects this light into an intense beam in the horizontal plane. Since the incandescent lamp emits light in a substantially uniform spatial radiation pattern the light collected and projected by the lighting device is substantially uniform in all directions of the 360 degree horizontal beam.

This uniformity is necessary because the lighting device should be equally visible from all directions. Unfortunately, casting the lens usually creates a ridge or parting line on its surface and this parting line obstructs light passing through the lens. A second obstruction is created by wires which are used to support the filament of the incandescent lamp. Both of these obstructions tend to reduce the intensity of the projected beam at one or more locations of the 360 degree horizontal beamspread.

Another prior art design, such as described in U.S. Pat. No. 5,224,773 includes groups of light emitting diode (LED) lamps with lens top bodies assembled in circular formation with their individual concentrated light beams directed radially outward towards the circular lens. These LED lamp assemblies are used as substitutes for the incandescent lamp. These designs are inefficient because they do not collect sufficient percentages of the created light into the required beam pattern. Most of the created light is misdirected due to the bodies of the LED lamps. Also since there is only one focal point, the lens cannot properly redirect the light from each of the plurality of LED lamps.

Finally, these assemblies are enclosed in a chamber of air which has a low thermal conductivity and therefore abets their failure due to overheating.

SUMMARY OF INVENTION

A plurality of light sources incorporating light emitting diode (LED) elements are used in cooperation with a curved cylindrical surface and light transmitting medium to construct a device which concentrates a maximum amount of the created light into a composite projected light beam pattern including a first beamwidth in a first reference plane and a second and smaller beamwidth in a normal reference plane. The projected light beam from the lighting device is a composite of the projected light beams from each of the individual LED sources. The light emitted from each of the individual LED sources is refracted at the exterior surface of the lighting device so that it emerges with a refracted or projected beam pattern that also includes a first beamwidth in the first reference plane and a second and smaller beamwidth in the normal reference plane. The geometric pattern axises of the individual projected light beams will usually intersect the first reference plane forming an included angle of substantially equal magnitude differing by less than five degrees. This permits the individual refracted light beams to overlap and combine into a single elongated high intensity composite light beam. The light emitting diode (LED) sources are encapsulated within a light transmitting medium. The light transmitting medium extends to the exterior surface of the lighting device where it forms a contoured exterior surface. The exterior surface forms a first intersection line shape when intersected by the first reference plane and a second intersection line shape when intersected by the plane normal to the first reference plane. The first line shape and the location of the LED elements cooperate to redirect light created by the LED elements into a composite projected output beam that projects a wide angle beam pattern with a horizontal beamwidth usually equal to that required by the specification. The second line shape and the location of the LED elements similarly cooperate to redirect light created by the LED elements into a projected output beam with a small vertical beamwidth also usually equal to that required by the specification. The fact that the required horizontal beamwidth exceeds the required vertical beamwidth permits the first line shape to be chosen to create less refraction reducing the misdirection of light in the horizontal plane. The inclusion of the light transmitting medium between the light sources and exterior surface deters refraction within the lighting device. This undesirable refraction would result in the apparent shifting or enlargement of the light source which would add to the misdirected light.

Each of the plurality of light emitting elements emits light with an angularly divergent spatial radiation pattern including a high intensity direction and a gradual intensity gradient. The prior art use of lens top LED lamps creates dark zones because the functioning lens creates a concentrated beam with a large intensity gradient. However, when these lamps are encapsulated in the light transmitting medium used in the current invention, the lens does not function and the gradual divergence is maintained. Thus the light transmitting medium further improves the device by maintaining the divergent spatial radiation pattern of the light emitting elements until the light passes through the exterior surface. By maintaining this divergent pattern azimuthal directions between sources obtain light energy from a multiplicity of light sources. This in turn reduces intensity variations or dark zones within the composite beam between light sources.

Concepts in this application are related to a patent application for a multiple lamp lighting device Ser. No. 08/144,653 filed on Oct. 28, 1993.

It is an object of the present invention to provide a lighting device that uses a plurality of LED elements to project a composite light beam with an elongated beam pattern using an optical system that optimizes the percentage of created light that contributes to that light beam.

It is a further object of the invention to provide lighting device that efficiently uses a plurality of LED elements and projects a light beam with improved consistency of intensity throughout the horizontal beamwidth.

DESCRIPTION OF THE PREFERRED EMBODIMENT

Figure 1:
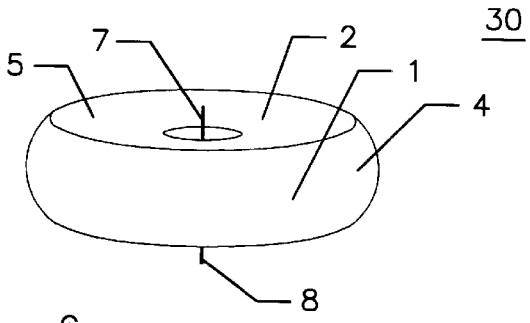
FIG. 1 is a perspective view of the preferred embodiment of the lighting device.
Figure 2:
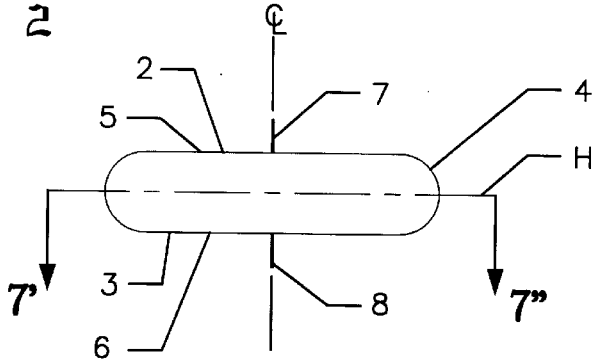
FIG. 2 is a front view of the FIG. 1 lighting device.
Figure 3:
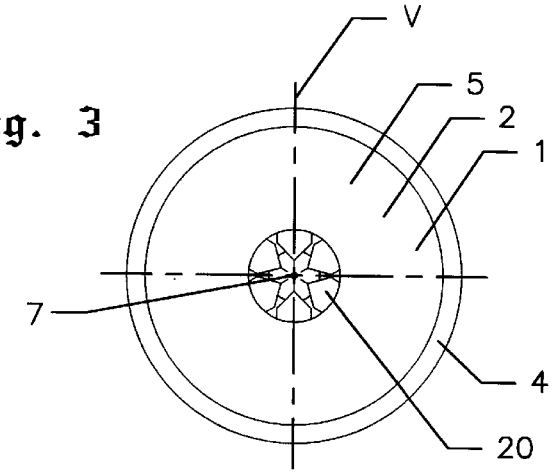
FIG. 3 is an elevation view of the FIG. 1 lighting device.

Referring now to FIGS. 1, 2, and 3 which are perspective, front and plan views respectively of lighting device 30, it can be seen that lighting device 30 consists of exterior light transmitting medium 1 forming curved exterior surface 4, top exterior surface 2 and bottom exterior surface 3. Top exterior surface 2 and bottom exterior surface 3 have top reflective coating 5 and bottom reflective coating 6 applied by a process such as vacuum metalizing. Wire leads 7 and 8 provide means to apply power. A vertical reference plane V is shown passing through vertical centerline CL.

Figure 4:
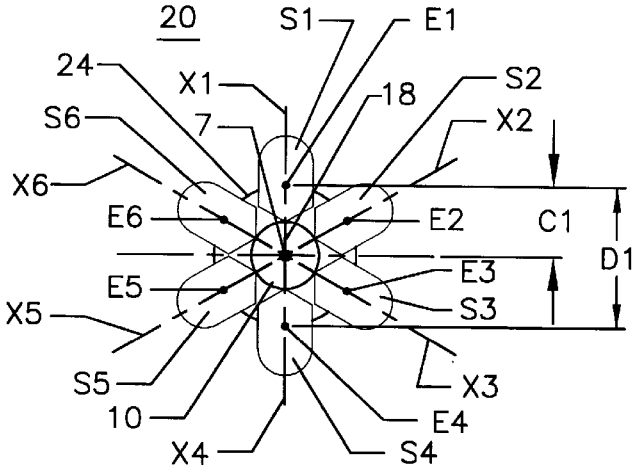
FIG. 4 is an enlarged view of the central portion of FIG. 3.
Figure 5:
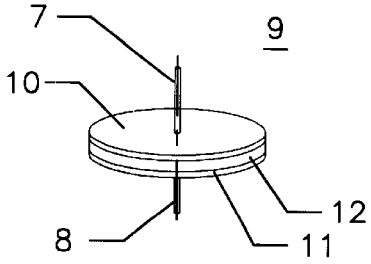
FIG. 5 is a perspective view of the circuit board removed from the FIG. 4 enlargement.

FIG. 4 is an enlarged view of lamp assembly 20 removed from the central section of FIG. 3. FIG. 5 is a perspective view of circuit board 9 removed from lamp assembly 20 of FIG. 4. It is a centrally located within lamp assembly 20 and distributes power from lighting device wire leads 7 and 8 to each of the component LED lamps S1 thru S6. Circuit board 9 has a conductive top surface 10 and a conductive bottom surface 11 separated by insulation 12.

Figure 6:
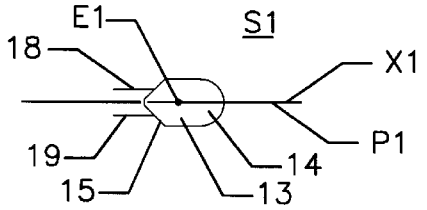
FIG. 6 is an illustrative view of a Light emitting diode lamp removed from FIG. 4.

FIG. 6 is a diagrammatic side view of LED lamp S1 removed from FIG. 4. It is identical in construction to lamps S2 thru S6. LED lamp S1 includes LED element El encapsulated in transparent body 13 which is contoured about geometric body axis X1 to form lens top 14 and chamfered base 15. LED element E1 generally emits light energy with a spatial radiation pattern with intensities that are related to the cosine of the angle between the direction of peak intensity usually along the geometric pattern axis P1 of the spatial radiation pattern and the selected direction. Geometric body axis X1 is coliniar with the geometric pattern axis P1 of the spatial radiation pattern of the light emitted from LED element E1. Lamp leads 18 and 19 provide a means to supply power to LED element E1.

Looking at FIGS. 4 thru 6, typical LED lamp S1 has lamp lead 18 soldered to conductive top surface 10 and lamp lead 19 soldered to bottom conductive surface 11 of circuit board 9. Other LED lamps S2 thru S6 are similarly connected so that power supplied to power lead wires 7 and 8 of circuit board 9 is distributed to all of the LED lamps. This is a parallel circuit arrangement but a series circuit or other arrangements with different quantities of LED lamps can obviously be made. Lamps S1 thru S6 are mounted in a circular formation with their geometric body axises equally angularly spaced and their LED elements in a circular pattern diametrically spaced at a distance D1.

Figure 7:
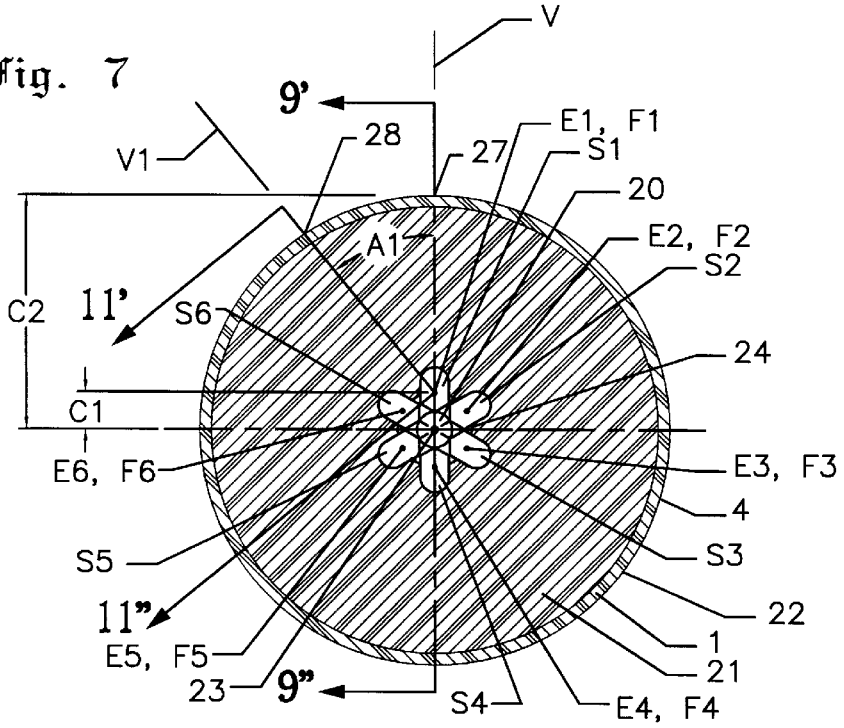
FIG. 7 is a cross-section view taken along line 7'-7" of FIG. 2.

FIG. 7 is a cross-sectional view taken along line 7'-7" in the horizontal plane H of FIG. 2. It shows lamp assembly 20 partially encapsulated in interior light transmitting medium 21. Exterior light transmitting medium 1 forms curved exterior surface 4 which when intersected by horizontal plane H forms intersection line 22 which is circular with a radius of curvature C2 and its center of curvature at point 23. Line 24 delineates the inside diameter of lighting device 30. It is circular with a radius of curvature C1 and a center of curvature also at point 23. For the present embodiment, radius of curvature C1 is equal to one half distance D1 of FIG. 4 so that LED elements E1 thru E6 lie on circular line 24. Lighting device 30 is filled with interior light transmitting medium 21 which can be a liquid or a solid. Optimum results are achieved when both interior light transmitting medium 21 and exterior light transmitting medium 1 are non-diffusing clear substances with indicies of refraction that are equal to each other and to that of body 13 of lamp S1. The index of refraction of air which normally surrounds lighting device 30 is 1.0. Therefore, in order to have adequate refraction at exterior curved surface 4 the index of refraction of exterior transparent medium 1 must exceed 1.1.

Figure 8:
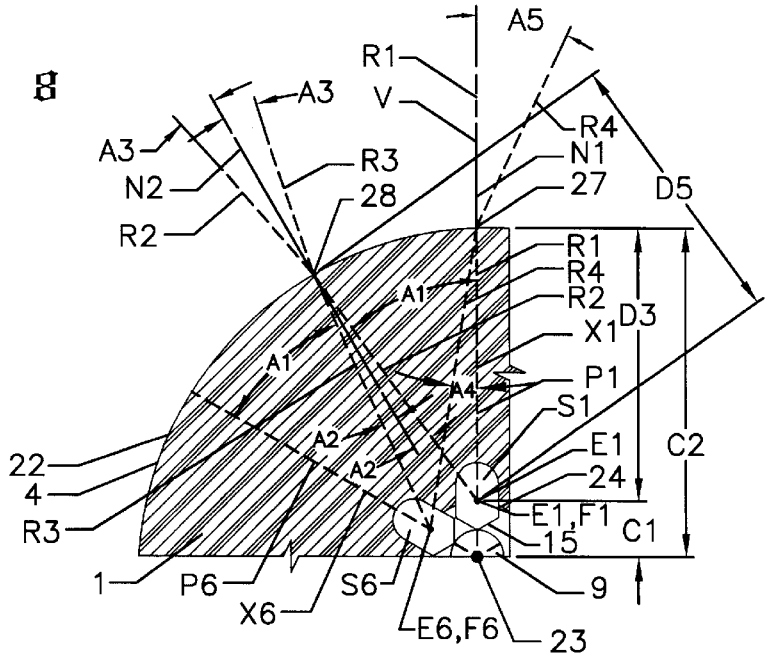
FIG. 8 is an enlargement of the upper left quadrant of FIG. 7.

FIG. 8 is an enlarged diagrammatic view of FIG. 7 including the upper left quadrant and it demonstrates the optics in the horizontal plane H relating to lamps S1 and S6. A single exterior transparent medium 1 functions as both interior transparent medium 21 and exterior transparent medium 1. This modification does not affect the optics to be described and is made here to simplify the discussion. In production the use of a single transparent medium can prevent a possible mismatch of indicies of refraction between transparent mediums and assures a totally continuous optical path for light traveling through the device.

In FIG. 8 light ray R1 emitted from lamp S1 along its geometric pattern axis P1 intersects intersection line 22 at point 27 along the normal N1 to line 22 at that point 27 and therefore, exits lighting device 30 without refraction. It should be understood that a single light ray has no intensity or energy. Therefore, all references to intensity, energy or light beams within this disclosure when discussing a particular light ray actually relate to the bundle of light rays of which the referenced light ray is typical. Since LED element E1 is a typical LED junction which emits light with a spatial radiation pattern that is most intense along its geometric pattern axis P1 light ray R1 represents a high intensity bundle of rays. Light ray R2 is also emitted by LED element E1 but it angularly diverges from geometric pattern axis P1 by angle A1 and therefore, according to the spatial radiation pattern of LED element E1 light ray R2 represents a bundle of light rays that is less intense than those represented by light ray R1. Light ray R2 intersects intersection line 22 at point 28. Normal N2 to intersection line 22 at point 28 forms included angle A2 with light ray R2. Since angle A2 is relatively small light ray R2 experiences only minimal refraction and emerges from curved exterior surface 4 at angle A3 relative to normal N2. Angle A3 is slightly larger than angle A2 but still small in magnitude. If lamp S1 were the only light source, the light energy passing through point 28 would be less than the light energy passing through point 27 because of the intensity differential between typical light rays R1 and R2. However, if we look at adjacent lamp S6, it emits light ray R3 also at angle A1 relative to its geometric pattern axis P6. Furthermore, light ray R3 also intersects intersection line 22 at point 28 and is minimally refracted whereupon it too emerges from curved exterior surface 4 at angle A3 relative to normal N2. Thus at point 28 light from two adjacent lamps combine such that the cumulative magnitude of light energy passing through point 28 can exceed the magnitude of light energy passing through point 27 from single high intensity light ray R1. A close look at refracted light rays R2 and R3 indicates that they each diverge slightly from normal N2 by angle A3 and would for that reason combine to represent a more divergent less intense projected beam then single high intensity light ray R1 which is directed along normal N1.

The spatial radiation pattern of light emitted by typical LED element E1 is angularly divergent and its created light energy is spread over a wide angle. This characteristic is necessary because even with the six lamp design described there is a 60 degree included angle between the geometric body axises of adjacent lamps. Energy must be radiated into the angular space between the lamps if the composite projected output light beam from the current invention is to appear uniform. In order to achieve this objective, each lamp must emit reasonable amounts of energy along directions that azimuthaly diverge from its geometric body axis by as much as 30 degrees. This requirement is met in the current invention because the LED elements within each of the lamps emit light with a spatial radiation pattern that includes a direction of high intensity along the geometric pattern axis and a gradual intensity gradient. The intensity of the emitted light in a defined direction is usually related to the cosine of the angle between the geometric pattern axis and the defined direction. Since the cosine of 30 degrees is 0.86 it is clear that point 28 in FIG. 8 is receiving substantial amounts of light energy from both lamps S1 and lamp S6. Hence the current invention forms a uniform composite projected beam.

Furthermore, the gradual intensity gradient of LED element E6 permits it to send energy to points on intersection line 22 representing directions which diverge from geometric pattern axis P6 by angles well beyond the approximate 30 degrees related to point 28. With this in mind looking at FIG. 8, it can be shown using the law of cosines that light ray R4 which intersects line 22 at point 27 and which represents a direction of divergence from geometric pattern axis P6 of approximately 60 degrees also delivers reasonable quantities of light energy emitted from LED element E6. Continuing analysis shows that LED element E6 will emit an acceptable but reduced quantity of light energy at angles of divergence even beyond 60 degrees permitting it to add to the energy passing through points on first reference plane intersection line 22 which lie to the right of point 27. Hence, each point on first reference plane intersection line 22 receives energy from a plurality of LED elements. This reinforcing and combining effect of light emitted by adjacent lamps results in a composite output projected beam which is of reasonably uniform intensity in all azimuthal directions.

The combining effect further benefits the design in that a scratch or surface defect at a point on curved exterior surface 4 will not drastically reduce the intensity in the direction along the normal to that point as now happens with the prior art designs that do not include a transparent medium. In the present invention, the intensity of the projected light in the direction along the normal to any point is a combination of light rays passing through a plurality of points on curved exterior surface 4. Therefore, a blockage at one point on exterior surface 4 will reduce but not devastate the intensity in the direction along the normal to that point.

Referring back to light ray R4, it can be seen that after intersecting intersection line 22 at point 27, it refracts relative to normal N1 and emerges from curved exterior surface 4 at angle A5 relative to normal N1. Angle A5 is larger than angle A3. Thus light rays which are emitted by LED element E6 and impinge upon distant points at large azimuthal angles of divergence their geometric pattern axis P6 will emerge from curved exterior surface 4 at disproportionally larger angles of divergence from the normals to these distant points. For most designs especially those requiring a beam pattern with a 360 degree horizontal spread, this is not a problem because the emerging light rays will simply add to the light in the direction of the normals at other points on first reference plane intersection line 22. This variation in the angle of emergence can be beneficial because it actually improves the uniformity of the projected output beam.

There are other specifications which require beam patterns with horizontal beam spreads less than 360 degrees or high intensities in a particular azimuthal direction. For these designs it is desirable to minimize the angle of divergence quantified by angle A3 between refracted light rays and their respective normals. This divergence can be reduced by reducing angle A2. One way to achieve this objective is by increasing the distance between lamps S1 thru S6 and point 28. In the described embodiment this distance is proportional to the difference between the magnitudes of radius of curvature C2 and radius of curvature C1. Hence increasing the magnitude of radius of curvature C2 will reduce angle A3. Unfortunately, this creates the undesirable effect of increasing the size of the lighting device. Alternatively reducing radius of curvature C1 by moving the lamps closer to point 23 at the center of the lighting device reduces the divergence between refracted light rays R2 and R3. This is a more desirable solution. In this regard, the chamfered base 15 on lamp S1 permits it to be mounted on a smaller circuit board 9 both closer to point 23 and lamp S6.

Locating the lamps close together can have negative consequences. If the LED lamps are clustered close together, the wide angle diverging spatial radiation pattern of their typical LED elements will cause light emitted from one lamp to strike the body of the adjacent lamp. Normally this light energy would be deflected and not contribute to the output light beam of the device. However, with a transparent medium between the lamps the light passes through the body of the adjacent lamp as if it were not there and exits the lighting device under control and adding to the energy of the projected light beam. Locating the lamps too close together can have a second negative effect in that it retards heat transfer from their light emitting junctions abetting their overheating. This problem is ameliorated by the high thermal conductivity of the internal light transmitting medium. Even with the advantage of the high thermal conductivity of the light transmitting medium separating the lamps so that their LED elements are at least 0.125 inches apart will be necessary in some high power designs if overheating is to be avoided.

Specifications which require horizontal beam spreads less than 360 degrees can also be met by positioning the lamps in an asymmetrical formation about point 23. For example, three lamps S1, S2, and S6 could be used alone to create a lighting device with a beamspread approximating 180 degrees.

Many commercial LED lamps include an internal reflector which redirects light which would normally miss curved exterior surface 4 because it is rearwardly emitted by its LED element. The redirected light adds to the spatial radiation pattern of the light emitted by the LED lamp and alters its compliance with the cosine law but the principals described herein are still valid.

In the present embodiment angle A4 does not approach the critical angle for the angle of incidence and total internal reflection is not a problem. However, this can be a problem for prior art designs which do not have interior light transmitting medium 21. In prior art designs due to the refraction at the interior wall of the lens for a particular curvature of curved exterior surface 4 distance D3 between curved exterior surface 4 and LED element E1 must be decreased to maintain a particular vertical beamwidth in the projected light beam. Reducing distance D3 increases angle A4 potentially reaching the critical angle resulting in total internal reflection.

Referring back to FIG. 7 tine 22 is circular with its center at point 23. However, it could also consist of intersecting straight or curved line segments. If normals drawn from these line segments converged generally in the direction of point 23, light emitted by each LED element into vertical planes which intersect the LED element and azimuthaly diverge from its geometric body axis could experience similar degrees of refraction. This would permit the lighting device to maintain the vertical beamspread regardless of the azimuthal angle of viewing and in so doing perform acceptably well.

Lamps S1 thru S6 are shown with lens top 14. These are common commercially available lamps such as model #CL00 manufactured by Hewlett Packard (trademark) with other models and body shapes available in a wide range of colors and electrical characteristics. In the present invention, the type of lens or body used on the LED lamps is not critical. This permits a larger selection from the commercial lamps that are available. Since the lamps are encapsulated in a transparent medium with an index of refraction substantially equal to that of the body of the lamp the lenses or optical features of their bodies do not function. Actually we do not want the body on an individual lamp to function as an optic because it would misdirect unacceptable quantities of light energy due to substantial uncontrolled refraction at the surface of the body as well as internal reflection due to the lens. In the horizontal plane H as shown in FIG. 8, light created by typical LED element E1 of the present invention emerges from both the individual lamp and the lighting device with minimal refraction. In the vertical plane refraction occurs only at curved exterior surface 4. This reduces internal losses resulting from internal reflection and improves the efficiency of the lighting device.

Even if the lens top 14 of typical lamp S1 did function without losses due to internal reflection, it would create problems for the current invention by making the intensity of the composite projected light beam vary depending upon the azimuthal direction of viewing. This occurs because lens top 14 of typical lamp S1 collects the light created by LED element E1 making it less divergent and more parallel to geometrical body axis X1 of the lamp. Thus for lamp S1 lens top 14 would increase the intensity of light in the direction of light ray R1 impinging upon point 27 along geometric body axis X1 but drastically reduce the intensity in the direction of light ray R2 impinging upon point 28. This would make the magnitudes of the projected light in the directions of normals N1 and N2 vastly different and reduce the uniformity of the composite output light beam of the lighting device.

If additional lamps were added to the present embodiment the energy passing through a particular point on intersection line 22 would be summed from an increasing quantity of lamps. This would increase the overall intensity of the projected light beam and further enhance the uniformity of its output. Adding lamps to the design would require an increase in the magnitude of radius of curvature C1 so that they could be physically accommodated. This increase could have negative consequences to be later described.

Figure 9:
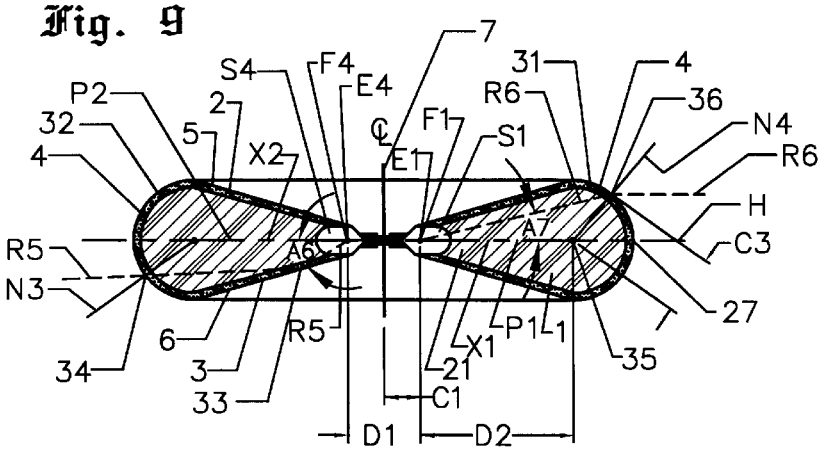
FIG. 9 is a cross-section view taken along line 9'-9" of FIG. 7.

FIG. 9 is a cross-sectional view taken in the vertical plane V across line 9'-9" of FIG. 7. It demonstrates the optical characteristics of lighting device 30 in the vertical plane V. Vertical plane V is perpendicular to curved exterior surface 4 at point 27 and it intersects LED elements E1 and E4.

By definition within this disclosure a normal reference plane is always perpendicular to horizontal plane H and first exterior surface 4. If it intersects a LED element, it becomes a related normal reference plane. A refraction reference plane is always perpendicular to horizontal plane H and always intersects a related LED element. It does not have to be perpendicular to first exterior surface 4. If it is perpendicular to curved exterior surface 4, it becomes identical to a related normal reference plane.

Vertical plane V which can also be considered a related normal reference plane intersects LED element E1 and perpendicularly intersects curved exterior surface 4 forming curved related normal lens line 31 on the right side of the drawing. On the left side of FIG. 9 it intersects LED element E4 and perpendicularly intersects curved exterior surface 4 forming curved related normal lens line 32. Horizontal plane H passes through LED elements E1 and E4. Looking at the left side of the drawing light ray R5 emitted from LED element E4 at angle A6 relative to horizontal plane H intersects bottom exterior surface 3 at point 33 whereupon it is redirected by reflective coating 6 towards related curved normal lens line 32. It then intersects curved exterior surface 4 along curved normal lens line 32 at point 34 and is refracted relative to normal N3 to curved normal lens line 32 at point 34 such that it emerges almost parallel to horizontal plane H. Since other similar light rays also redirected by reflective coating 6 intersect that coating at a variety of angles, those redirected light rays will not emerge parallel to horizontal plane H. Furthermore, since each of those redirected light rays will strike curved normal lens line 32 at different points and at different angles with respect to the normals at those points these light rays will be refracted differently making it even more difficult to establish the control necessary to direct them into the output composite beam. Nevertheless light redirected by bottom reflective coating 6 and top reflective coating 5 does add to the output of the lighting device.

Figure 10:
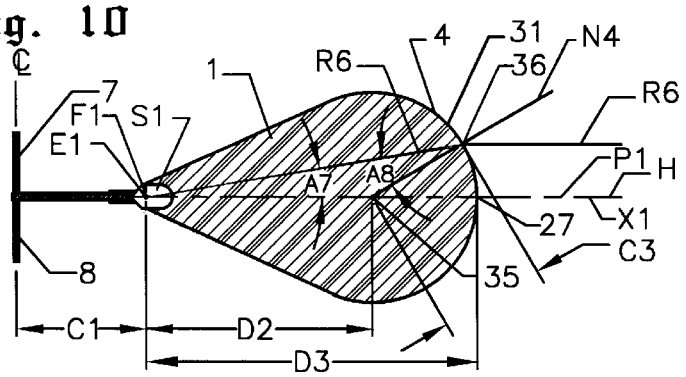
FIG. 10 is a diagrammatic enlargement of the right half of FIG. 9.

FIG. 10 is a diagrammatic enlargement of the right half of FIG. 9. For reasons previously described external transparent medium 1 has been extended to the light sources and simultaneously functions as internal transparent medium 21. At the right side of the drawing curved normal lens line 31 is circular with radius of curvature C3 and center of curvature at point 35. The distance from LED element E1 to point 35 is D2. In the present embodiment which is surrounded by air with an index of refraction of 1.0 exterior transparent medium 1 has an index of refraction of 1.5. Distance D2 is twice radius of curvature C3. Normal lens line 31 is formed at the intersection of vertical plane V with curved exterior surface 4. Vertical plane V is perpendicular to horizontal plane H, intersecting LED element E1 and perpendicular to curved exterior surface 4, therefore normal lens line 31 can be considered related to LED element El. Due to the described optical parameters LED element E1 is located at focal point F1 of normal lens line 31. Light ray R6 emerging from LED element E1 at an angle A7 above horizontal plane H intersects curved normal lens line 31 at point 36 forming included angle A8 with normal N4 to curved normal lens line 31 at point 36 whereupon it is refracted relative to normal N4. Refracted light ray R6 is substantially parallel to horizontal plane H due to the fact that LED element E1 is at focal point F1 of its normal lens line 31. Other light rays emerging from LED element E1 at angles of emergence different than angle A7 but also small enough to be substantially paraxial will also emerge from curved exterior surface 4 parallel to horizontal plane H. LED elements E2 thru E6 as seen in FIGS. 4 and 7 are also each coincident with their respective focal points F2 thru F6. Therefore, their emitted light which passes through curved exterior surface 4 will also emerge parallel to horizontal plane H. It can be seen that all of the LED elements E1 thru E6 and their focal points F1 thru F6 are located on line 24. Therefore, line 24 can be considered a focal line for curved exterior surface 4. The entire focal line which would consist of an infinite number of focal points could be generated by creating an infinite number of normal lens lines. In the current configuration, there are only six LED elements. If a related normal reference plane similar to vertical plane V is drawn for each of these LED elements intersecting that element, perpendicular to horizontal plane H and perpendicular to curved exterior surface 4 each of these related normal reference planes will intersect curved exterior surface 4 to form a distinct related normal lens line. Each of these related normal lens lines will be related to its intersected LED element and will using classical optics define a focal point. Thus we will only be able to establish six focal points. Additional focal points can be located by constructing normal reference planes not related to a particular LED element. Referring to FIG. 7, if at each point on line 22 a normal reference plane which is perpendicular to horizontal plane H and perpendicular to curved exterior surface 4 is drawn that normal reference plane will intersect curved exterior surface 4 to form a normal lens line, although unrelated to a particular LED element each of these normal lens lines has a focal point with the locus of these focal points defining the focal line.

Usually it is desirable to design the lighting device such that all of the light emitted by each LED element above and below horizontal plane H is redirected by curved exterior surface 4 so that it emerges parallel to the horizontal plane H. In this regard, it is the function of curved exterior surface 4 to refract the light emitted by each LED element into its related normal reference plane so that the light rays emerge more parallel to each other. Refraction should enhance the parallelism of the light rays in the related normal reference plane. The refracted light emerging from curved exterior surface 4 has a spatial radiation pattern with its own peak intensity, angular divergence and geometric pattern axis. The angular divergence between the light rays emitted by LED element E1 in the vertical plane is reduced as those light rays typical of light ray A1 intersect and are refracted at curved exterior surface 4. Thus the light energy per unit of angle of the spatial radiation pattern of the light emerging from curved exterior surface 4 is larger than the light energy per unit of angle of the spatial radiation pattern of the light emitted from the LED element. Consequently the vertical angular beamspread of the light leaving curved exterior surface 4 will be less than the vertical angular beamspread of the light emitted by LED element E1 which enters curved exterior surface 4. Generally, the angular beamspread of a spatial radiation pattern includes all the directions representing intensities equaling a defined percentage—usually 10 percent—of the peak intensity. Also, the intensity of the light leaving curved exterior surface 4 will generally be greater than the intensity of the light emitted by LED element E1. For typical paraxial light ray R6 in FIG. 10, the shape of related normal lens line 31, location of point 35, magnitude of radius of curvature C3 and magnitude of distance D2 have all been selected to conform to the equation for optical spherical surfaces which assures that emerging light ray R6 is parallel to horizontal plane H. Usually it is desirable to follow the design of the present embodiment in which each of the six LED elements E1 thru E6 each emit their light towards a related normal lens line which is identical both in shape and in location relative to its related LED element. The difference between the magnitudes of any two of said radii of curvature does not exceed 0.125 inch. However, the various related normal lens lines do not have to be identical in shape. There are numerous combinations of the optical parameters which will assure that typical light ray R6 emerge parallel to horizontal plane H. As long as the quotient of distance D2 divided by the sum of distance D2 and radius of curvature C3 is maintained light rays emitted by any LED element towards its related normal lens line will emerge parallel as required.

It should be noted that even when all optical parameters are properly selected to assure that all typical light rays emitted by a particular LED element towards its related normal lens line are refracted to emerge parallel to horizontal plane H, in practice, this objective is never achieved. The refracted emerging light rays will always have some divergence and will eventually intersect horizontal plane H although the included angle of intersection will be very small. This divergence results from the finite size of each LED element, inaccuracies regarding placement of the LED element and the exact shape and location of the normal lens line. A common objective of the designer is to minimize this divergence by controlling related parameters. In this regard, the size of the LED element is not easily altered. However, unwanted beam divergence resulting from a LED element of finite size can be reduced by increasing distance D2 and radius of curvature C3, while maintaining their necessary relationship as previously stated. This must be done for each LED element. If each LED element had its own separate lens designed to include the increased distances D2 and radius of curvature C3, the overall size of the lighting device would become unacceptably large. In the present invention, portions of curved exterior surface 4 productively redirect light emitted by a plurality of LED elements. By using a common curved exterior surface for a plurality of LED elements the emerging beam divergence is minimized while the overall size of the lighting device is kept within acceptable limits.

As previously described, the use of an interior transparent medium 21 eliminates the interior refractive wall of prior art and for a particular radius of curvature C3 increases distance D2 thereby helping to reduce unwanted divergence.

Positioning each of the plurality of LED elements at a precise desired location relative to the focal point of their related normal lens lines is also not possible. Differences between components and limitations of the manufacturing process result in variations and these variations can shift the direction of the individual refracted output light beam. The direction of a light beam is generally considered the direction of the geometric pattern axis of the light beam. No light beam will emerge perfectly parallel to horizontal plane H. The geometric axis of the beam will always eventually intersect horizontal plane H although the angle of intersection can be very small. For a particular magnitude of variation in the location of the LED element increasing distance D2 reduces the magnitude of the angular shift in the direction of the individual refracted light beam. Thus the elimination of the interior refractive wall of prior art and the resulting increases in distance D2 ameliorates both the problem of excessive divergence and beam shift.

The concept of a common curved exterior surface is especially valuable for specifications which require a wide angle projected beam in a first reference plane such as the horizontal plane and a reduced beamspread in the vertical or related refraction reference plane defined in the present embodiment. In order to meet these requirements, a plurality of LED elements are located in the horizontal or first reference plane. Usually they are positioned close to the center of curvature of a first reference plane intersection line created by the intersection of a horizontal plane H with curved exterior surface 4. The location of each light source relative to the center of curvature of the first reference plane intersection line will affect the respective individual horizontal beamspread. However, their exact location relative to the first reference plane intersection line is usually not critical because we do not need to concentrate the light in the first reference plane. The situation is different in the related refraction reference plane wherein the location of each LED element relative to its related refraction lens line should be precisely controlled. Each LED element is normally located near the focal point of its related refraction reference plane intersection line so that the refracted light has reduced beamspread in the related refraction reference plane. As previously described in FIG. 10, LED element E1 is positioned at focal point F1 of its related normal lens line 31 and therefore, light it emits into its related refraction reference plane is refracted so that it leaves curved exterior surface 4 parallel to horizontal plane H. LED elements E2 thru E6 are similarly positioned in relation to their related normal lens lines so that the light energy emitted by each of them into its related refraction reference lane is refracted to emerge from curved exterior surface 4 parallel to horizontal plane H. In most designs, the radius of curvature of the first reference plane intersection line is substantially larger than the radius of curvature of a particular related refraction reference plane intersection line so that the angular beamspread of the light beam in the horizontal plane for each light source exceeds the angular beamspread in the related refraction reference plane. The maximum included angle between any two of all the possible straight lines that can be drawn between an intersected LED element and said first intersection line is greater than the maximum included angle between any two of all the possible straight lines that can be drawn between said intersected LED element and its related refraction lens line.

Since in the present embodiment it is desired to create a projected light beam with equal quantities of energy above and below, horizontal plane H LED elements E1 thru E6 are located so that they are intersected by horizontal plane H. It is not always physically possible to locate LED elements E1 thru E6 exactly as desired on a first reference plane such as the horizontal plane H of the present embodiment. However, generally each of the LED elements should be located as close to or at least within 0.125 inch of horizontal plane H so that their individual refracted light beams will emerge after refraction from curved exterior surface 4 capable of combining to form a composite beam.

Locating the entire group of LED elements E1 thru E6 at a fixed distance above or below horizontal plane H will angle the geometric pattern axises of the individual refracted light beams so that they intersect the horizontal plane at a common angle. Consequently the composite projected light beam will diverge from the horizontal plane at that common angle. This result can be desirable for some requirements such as airport use when an upward tilt of the composite projected light beam is required.

In FIG. 10 geometric pattern axis P1 of lamp S1 is parallel to horizontal plane H. This is the most common location, however, it could be tilted upward so that geometric pattern axis P1 intersects horizontal plane H. This would increase the quantity of light energy emerging from curved exterior surface 4 above the horizontal plane H and decrease the quantity emerging below horizontal plane H. This upward tilted projected beam may also find application for airport use. A downward tilt of the projected beam can be achieved by angling the geometric pattern axises of the LED elements downward below horizontal plane H. Generally, the tilt of the geometric pattern axis should not exceed 30 degrees.

Each of the LED elements could also be located at a fixed horizontal distance either rearward or forward of its related focal point. This would increase the vertical beamspread of the light beam emerging from curved exterior surface 4 a result which is desirable for some requirements. However, even for specifications which require increased vertical beamspread uniformity of beamspread is desirable and achieved by positioning all of the LED elements at the same fixed distance from their related focal points.

Figure 11:
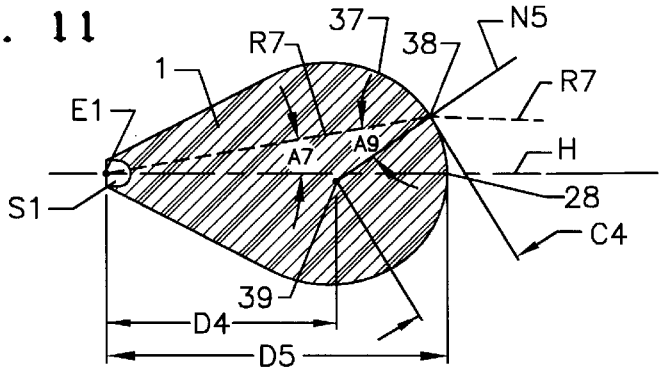
FIG. 11 is a cross-section view taken along line 11'-11" of FIG. 7.

FIG. 11 is a cross-sectional view taken in the vertical plane V1 across line 11'-11" of FIG. 7. As in FIG. 10, a single exterior transparent medium 1 substitutes for both interior transparent medium 21 and exterior transparent medium 1. Vertical plane V1 which can be considered a related refraction reference plane intersects curved exterior surface 4 to form related refraction lens line 37. Light ray R7 emerges from LED element E1 of lamp S1 at angle A7 relative to horizontal plane H wherein it intersects related refraction lens line 37 at point 38 to form included angle A9 with normal N5 at point 38. Related refraction lens line 37 is not perfectly circular. However, at point 38 related refraction lens line 37 can be considered substantially circular with radius of curvature C4 and center of curvature at point 39. LED element E1 is located at distance D4 from center of curvature point 39. Distance D4 is slightly larger than distance D2 of FIG. 10 and this alone would tend to make light emitted by LED element E1 into vertical plane V1 experience substantially different refraction than light emitted into vertical plane V. The difference in refraction would result in a difference in vertical beamspread dependent upon the direction of azimuthal viewing. Specifically, refracted light ray R7 would emerge converging upon horizontal plane H. The group of light rays represented by light ray R7 emitted into plane V1 and emerging from curved exterior surface 4 would first converge towards horizontal plane H then diverge to form a projected beam with an undesirably large angular divergence. Thus, light ray R7 like light ray R6 of FIG. 10 emerges from LED element E1 at the same angle A7 relative to horizontal plane H, however, they emerge from curved exterior surface 4 at different angles relative to horizontal plane H. This is an undesirable characteristic for most lighting devices as the beamspread is usually required to be minimal and consistent in magnitude regardless of the angle of viewing.

Fortunately, related refraction lens line 37 has another parameter which tends to counter the negative effect of distance D4 exceeding distance D2. Radius of curvature C4 is larger than radius of curvature C2. Because of this the quotient of the magnitude of distance D4 divided by the sum of the magnitudes of distance D4 and radius of curvature C4 of FIG. 11 is more equal to the quotient of the magnitude of distance D2 divided by the sum of the magnitudes of distance D2 and radius of curvature C3 found in FIG. 10. Since the quotients are more equal light ray R7 which azimuthaly diverges from vertical plane V of FIG. 7 by approximately 30 degrees will experience vertical refraction more closely approximating the refraction of light ray R6 of FIG. 10 which is parallel to vertical plane V.

Distance D4 increases in magnitude relative to distance D2 more rapidly than radius of curvature C4 increases in magnitude relative to radius of curvature C2 and therefore the increased magnitude of radius of curvature C4 reduces but does not eliminate the problem related to an increased magnitude of distance D4. Since most of the light emitted from LED element E1 azimuthaly diverges from vertical plane V of FIG. 7 it is critical to assure that emitted light regardless of its angle of azimuthal divergence experiences similar refraction. If this objective is achieved and the degree of refraction experienced by light rays intersecting the related normal lens lines typified by line 31 is substantially equal to the degree of refraction experienced by the light rays intersecting the related refraction lens lines typified by line 37 then the beamspread of the projected beam in the vertical plane will be consistent regardless of the azimuthal angle of viewing. In order to achieve this objective, it is noteworthy to realize that distance D4 always increases relative to distance D2 as the azimuthal angle of divergence of the emitted light ray relative to its geometric pattern axis P1 increases. Increasing distance D4 always causes the related light ray to be refracted to more quickly converge upon horizontal plane H. Furthermore, the change in the angle of convergence of the refracted light ray relative to the horizontal plane H is not linear but increases more rapidly at larger angles of azimuthal divergence of the emitted light ray from its geometric pattern axis. These facts make it possible to further improve the design. Looking at FIG. 10, LED element E1 can be located slightly in front of focal point F1 so that distance D2 is slightly short of focal point F1 causing refracted light ray R6 to emerge from curved exterior surface 4 slightly diverging from horizontal plane H. Now refracted light ray R7 in FIG. 11 will because its azimuthal divergence from vertical plane V causes it to be biased to converge towards horizontal plane H counter the diverging effect of a shortened distance D1 and end up emerging parallel horizontal plane H. The result is that light represented by light ray R7 emitted at azimuthal angles of divergence from its geometric pattern axis P1 of approximately 30 degrees will emerge parallel to horizontal plane H. Light emitted at angles of divergence greater than 30 degrees will emerge at first slightly converging then after intersecting horizontal plane H emerge slightly diverging. Finally, light emitted at angles of divergence less that 30 degrees will emerge slightly diverging from horizontal plane H. The overall result is an improved lighting device with minimal and reasonably uniform beamspread. The foregoing analysis also holds for light rays emerging at angles of divergence other then 30 degrees. Thus if properly designed the optical characteristics of lighting device 30 can be controlled such that light emerging from LED element E1 at various angles of azimuthal divergence from its geometric pattern axis and impinging upon curved exterior surface 4 will experience minimal differences in refraction in the vertical plane.

Figure 12:
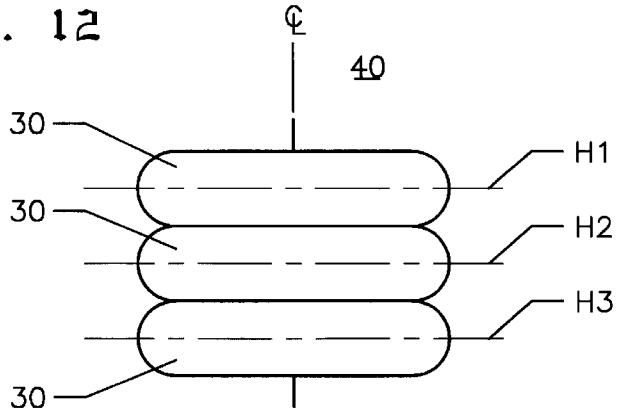
FIG. 12 is a front view of lighting device 40 which is constructed using three FIG. 1 lighting devices.

FIG. 12 is a perspective view of a lighting device 40 which incorporates three lighting devices 30 stacked so that their horizontal reference planes H1, H2 and H3 respectively are parallel. Using this configuration, the composite projected light beams from each of the three component lighting devices combine at a distance to form a composite high intensity output beam.

Generally, for a light source of a given size the larger the housing, the better the control of the created light. Therefore in order to adequately control the created light for some difficult specifications it would not be unusual for light emitted by the LED elements to pass through a 0.375 inch thickness of light transmitting medium before it exits the housing. The transmission of the emitted light should exceed 80 percent for this thickness in order to avoid excessive light absorption and de creased efficiency. Hence, selection of the light transmitting medium must be made with due regard to its transmission and absorption at the wavelength of the created light at the thickness of the design. Acrylic is a good choice for created light in the visible wavelengths because it has very low light absorption in thick sections.

Manufacturing problems can result from thick sections of the light transmitting medium and the shrinkage and distortion which accompany the casting process. Casting around a light source with a body reduces the maximum thickness and can ameliorate casting problems. An alternate design uses liquid as the interior light transmitting medium. The liquid eliminates the casting of a thick section of light transmitting medium. Due to convection it also further improves the transfer of heat from the light sources.

In lighting device 30, we have incorporated light sources typified by light source S1 as shown in FIG. 6 which is a typical commercially available discrete LED lamp including a transparent body 13. However, it is sometimes desirable to construct lighting device 30 using light sources without discrete bodies in order to eliminate light energy losses at the interface of the source body and interior light transmitting medium. In this configuration, the tight sources would have no body and interior light transmitting medium 21 would encapsulate the LED elements directly. This embodiment permits the plurality of LED elements to be placed closer to point 23 and in so doing derive the advantages from that placement as previously described.

Having now fully set forth the preferred embodiments and certain modifications of the concept underlying the present invention, various other embodiments as well as certain variations and modifications of the embodiment herein shown and described will obviously occur to those skilled in the art upon becoming familiar with said underlying concept. For instance, although this disclosure centered on visible light, the concepts described and the term light are meant to include all electromagnetic radiated energy including the infrared portion of the spectrum.

It is to be understood, therefore, that within the scope of the appended claims, the invention may be practiced otherwise then as specifically set forth herein.

What is claimed is:

1. A lighting device comprising a plurality of lamps disposed in a radial array in a common reference plane about a common axis, each lamp including a light emitting diode element for emitting light rays therefrom in an angularly divergent radiation pattern relative to said common reference plane; and a light transmitting medium having an index of refraction exceeding 1.1 about said radial array of lamps, said medium having an exterior surface curved transverse to said reference plane and curved peripherally about said lamps to receive and transmit light rays from said lamps.

2. A device as set forth in claim 1 which further comprises a circuit board centrally of electrically connected to said lamps, said circuit board having a pair of conductive surfaces, and a pair of leads for supplying power to said circuit board, one of said leads being connected to one of said conductive surfaces and the other of said leads being connected to the other of said conductive surfaces.

3. A device as set forth in claim 1 wherein said light transmitting medium is a solid medium and has a pair of light reflective coatings on opposite sides thereof extending from said lamps to said curved exterior surface.

4. A device as set forth in claim 1 wherein each diode element of each lamp is equi-spaced from said common axis relative to the other of said diode elements.

5. A device as set forth in claim 1 wherein each lamp emits light rays in a pattern angular to said reference plane.

6. A lighting device comprising a plurality of lamps disposed in a radial array in a common reference plane about a common axis, each lamp including a light emitting diode element for emitting light rays therefrom in an angularly divergent radiation pattern relative to said common reference plane; and a light transmitting medium having an index of refraction exceeding 1.1 and a curved exterior surface about said radial array of lamps, said surface being curved transverse to said reference plane and curved peripherally about said lamps to receive all of said rays in said pattern from said lamps and to redirect said rays to emerge parallel lo said reference plane.

7. A device as set forth in claim 6 which further comprises a solid light transmitting medium between said array of lamps and said exterior surface, and a pair of light reflective coatings on opposite sides of said solid light transmitting medium extending from said lamps to said curved exterior surface.

8. A lighting device comprising a plurality of lamps disposed in a radial array in a common reference plane about a common axis, each lamp including a light emitting diode element for emitting light rays therefrom in an angularly divergent radiation pattern; and a light transmitting medium about said radial array of lamps, said medium having an exterior surface curved transverse to said reference plane and curved peripherally about said lamps to receive and transmit light rays from said lamps whereby the light energy per unit of angle of the spatial radiation pattern of light emerging from said curved surface is larger than the light energy per unit of angle of said radiation pattern of light emitted from a respective diode element.

9. A lamp comprising a vertical stack of lighting devices;

each lighting device including a plurality of lamps disposed in a radial array in a common horizontal plane thereof about a common axis, each lamp including a light emitting diode element for emitting light rays therefrom in an angularly divergent radiation pattern; and a light transmitting medium about said radial array of lamps, said medium having an exterior surface curved transverse to said reference plane and curved peripherally about said lamps to receive and transmit light rays from said lamps whereby the light beams projected from said lighting devices combine at a distance to form a composite high density output beam.

10. A lighting device including a plurality of light sources, each emitting a light having a divergence about a first reference plane and each incorporating a related LED element;

each of said light sources having a related reference plane disposed perpendicular to said first reference plane and intersecting said related LED element;

said light from each of said light sources additionally having a divergence about said related reference plane;

a circuit means coupled to each of said light sources for supplying power to each of said light sources;

a light transmitting medium having an index of refraction exceeding 1.1 and a first surface disposed at a distance from said plurality of light sources and intersecting said light emitted from each of said light sources for at least a common portion of said first surface to refract said light at substantially said divergence about said first reference plane and bringing said light towards parallelism with said first reference plane.

11. A lighting device including a plurality of light sources each emitting a light having a divergence about a first reference plane and each incorporating a related LED element;

each of said light sources having a related reference plane disposed perpendicular to said first reference plane and intersecting said related LED element;

said light from each of said light sources additionally having a divergence about said related reference plane;

a circuit means coupled to each of said light sources for supplying power to each of said light sources; and a light transmitting means comprising a light transmitting medium having an index of refraction exceeding 1.1 for encapsulating each of said light sources, extending a distance from each of said light sources and forming a first surface, and said first surface disposed at a distance from said plurality of light sources for intersecting said light emitted from each of said light sources to refract said light emitted from each of said light sources and to bring said light towards parallelism with said first reference plane.

12. A lighting device including a plurality of light sources each emitting a light having a divergence about a first reference plane and each incorporating a related LED clement;

each of said light sources having a related reference plane disposed perpendicular to said first reference plane and intersecting said related LED element;

said light from each of said light sources additionally having a divergence about said related reference plane;

a circuit means coupled to each of said light sources for supplying power to each of said light sources;

a light transmitting medium having an index of refraction exceeding 1.1 and a first surface coupled to said plurality of light sources and disposed at a distance from said plurality of light sources and intersecting said light emitted from each of said light sources for refracting said light and bringing said light towards parallelism with said first reference plane;

each said related reference plane intersecting said first surface forming a related lens line; and each said related lens line having a related focal point approximately at its said related LED element.

13. A lighting device according to any of claims 10, 11 and 12 wherein said light transmitting medium further comprises an interior light transmitting medium located between said first surface and each of said light sources.

14. A lighting device according to any of claims 10, 11 and 12 wherein said light transmitting medium further comprises a liquid interior light transmitting medium located between said first surface and each of said light sources.

15. A lighting device according to any of claims 10, 11 and 12 wherein said light transmitting medium has a transmissivity of said light emitted by each of said light sources exceeding 80 percent through a thickness of 0.375 inches.

16. A lighting device according to any of claims 10, 11 and 12 wherein each of said light sources further comprises a transparent medium encapsulating its said related LED element.

17. A lighting device according to any one of claims 10, 11 and 12 wherein said light transmitting medium is an acrylic plastic.

18. A lighting device according to any of claims 10, 11 and 12 wherein each said LED element is located within 0.125 inch of said first reference plane.

19. A lighting device according to any claims 10, 11 and 12 wherein each of said light sources has a spatial radiation pattern comprising a direction of high intensity and gradual intensity gradient.

20. A lighting device according to any of claims 10, 11 and 12 wherein each of said plurality of light sources is disposed at a substantially equal distance from said first reference plane.

21. A lighting device according to any of claims 10 and 11 wherein said first reference plane intersects said first surface to form a first intersection line having a plurality of line segments; and wherein normal lines disposed in said first reference plane normal to each of said line segments coverage.

22. A lighting device according to any of claims 10 and 11 wherein said first reference plane intersects said first surface to form a first intersection line; and wherein said first intersection line is a concave curve.

23. A lighting device according to any of claims 10, 11 and 12 which further includes a transparent medium between each of said plurality of light sources.

24. A lighting device including a first plurality of light sources each emitting a light with a divergence about a first reference plane and each incorporating a related LED element;

a light transmitting medium coupled to said first plurality of light sources and disposed to intersect said light emitted from each of said first plurality of light sources for a common portion of a first surface thereof to refract said light at substantially said divergence emitted from each of said first plurality of light sources and bringing said light towards parallelism with said first reference plane;

a second plurality of light sources each emitting a light with a divergence about a second reference plane and each incorporating a related LED element;

a circuit means coupled to said first plurality of light sources and to said second plurality of light sources for supplying power to each of said light sources; and a second light transmitting medium coupled to said second plurality of light sources and disposed to intersect said light emitted from each of said second plurality of light sources for a common portion of a second surface thereof to refract said light at substantially said divergence emitted from each of said second plurality of light sources and bringing said light towards parallelism with said first reference plane; wherein light refracted by said first surface and light refracted by said second surface combine to form a composite light bean.

25. A lighting device including a light source incorporating a LED element emitting a light upon the application of an electrical power;

a circuit means coupled to said light source for the application of said electrical power to said light source;

said light having a divergence about a first reference plane disposed intersecting said LED element and a divergence about a second reference plane disposed intersecting said LED element and being perpendicular to said first reference plane;

a light transmitting medium with an index of refraction exceeding 1.1 forming a first surface means;

said first surface means having a first surface coupled to said LED element and disposed at a distance from said LED element intersecting said light, for refracting said light and bringing said light towards parallelism with said first reference plane, said first surface at least partially surrounding said LED element, and said disposed first surface intersecting said light;

said first surface intersecting said first reference plane forming a first curved line;

said first surface intersecting said second reference plane forming a second curved line having a radius of curvature less than a radius of curvature of said first curved line.

26. A lighting device including a light source incorporating a LED element emitting a light upon the application of electrical power, said light having a divergence about a first reference plane disposed intersecting said LED element and a divergence about a second reference plane disposed intersecting said LED element and being perpendicular to said first reference plane;

a circuit means coupled to said light source for the application of electrical power to said light source; and a light transmitting medium with an index of refraction exceeding 1.1 forming a first surface means coupled to said LED element and disposed at a distance from said LED element to intersect said light for refracting said light at substantially said divergence about said first reference plane and forming a light beam having a first angular beam width in said first reference plane and a second smaller angular beam width in said second reference plane.

27. A lighting device including a light source incorporating a LED element emitting a light upon the application of an electrical power, said light having a divergence about a first reference plane disposed intersecting said LED element;

a circuit means coupled to said light source for the application of said electrical power to said light source;

an exterior light transmitting medium with an index of refraction exceeding 1.1 forming a first surface means at a first distance from said LED element;

a liquid interior light transmitting medium with an index of refraction exceeding 1.1 between said exterior light transmitting medium and said LED element;

a means coupled to said first surface means for holding said liquid interior light transmitting medium between said exterior light transmitting medium and said light source; and said first surface means, coupled to said LED element and disposed at a distance from said LED element intersecting said light, for refracting said light and bringing said light towards parallelism with said first reference plane.

28. A lighting device comprising a curved cylindrical light transmitting surface;

a light emitting diode for directing light towards said surface; and a light transmitting medium encapsulating said diode and extending to said curved surface.

29. A lighting device as set forth in claim 28 wherein said curved surface has a first line shape in a first cross-sectional plane and a second line shape in a second cross-sectional plane normal to said first cross-sectional plane, said first line shape being located relative to said diode to redirect light from said diode into a projected output beam pattern with a first beam width in one plane and said second line shape being located relative to said diode to redirect light from said diode into a projected output beam pattern with a second beam width in a second plane transverse to said first beam width and less than said first beam width.

30. A lighting device as set forth in claim 28 which further comprises a side exterior surface about said light transmitting medium having a finish thereon to reflect light from said diode.

31. A lighting device comprising a least one light emitting diode element for emitting light rays therefrom in an angularly divergent radiation pattern relative to a reference plane; and a light transmitting medium having an index of refraction exceeding 1.1 spaced from said light emitting diode element, said medium having an exterior surface comprising a first curve in said reference plane and a second and different curve from said first curve in a plane transverse to said reference plane to receive and transmit light rays from said light emitting diode element.

* * * * *

UNITED STATES PATENT AND TRADEMARK OFFICE

CERTIFICATE OF CORRECTION

PATENT NO. : 5,899,557

DATED : May 4, 1999

INVENTOR(S) : Kevin McDermott

It is certified that error appears in the above-indentified patent and that said Letters Patent is hereby corrected as shown below:

Column 7, line 8, change "tine" to -line-

Column 8, line 11, change "." to -,-

Column 11, line 21, change "." to -,-

Column 17, line 54, change "bean" to -beam-

Signed and Sealed this

Twenty-eighth Day of September, 1999

*Attest:*

Q. TODD DICKINSON

*Attesting Officer*

*Acting Commissioner of Patents and Trademarks*